United States Patent [19]

Schmidt et al.

[11] 4,253,384

[45] * Mar. 3, 1981

[54] VENTILATING AND AIR CONDITIONING ARRANGEMENT

[75] Inventors: Friedrich H. Schmidt, Cologne; Fritz Reuter, Meckenheim-Altendorf; Wolfgang Radtke, Steinenbrück, all of Fed. Rep. of Germany

[73] Assignee: Schmidt Reuter Ingenieurgesellschaft mbH & Co. KG, Cologne, Fed. Rep. of Germany

[ * ] Notice: The portion of the term of this patent subsequent to Jan. 23, 1996, has been disclaimed.

[21] Appl. No.: 895,656

[22] Filed: Apr. 12, 1978

[30] Foreign Application Priority Data

Apr. 18, 1977 [DE] Fed. Rep. of Germany ..... 2716993

[51] Int. Cl.³ ..... F24F 7/00

[52] U.S. Cl. ..... 98/40 R; 98/40 B; 98/40 E; 98/41 SV

[58] Field of Search ..... 98/40 R, 40 A, 40 B, 98/40 C, 40 D, 40 E, 40 N, 41 R, 41 S, 36; 108/50; 312/236

[56] References Cited

U.S. PATENT DOCUMENTS

| | | | |
|---|---|---|---|
| 3,204,545 | 9/1965 | Benson | 108/50 |
| 3,354,808 | 11/1967 | Macrow | 98/40 C |
| 3,366,363 | 1/1968 | Hogan et al. | 98/40 A |
| 3,802,328 | 4/1974 | Kakizaki | 98/40 A |
| 3,803,995 | 4/1974 | Allander | 98/36 |
| 3,812,904 | 5/1974 | Westergren | 98/40 D |
| 3,835,759 | 9/1974 | Lloyd | 98/40 A |
| 3,881,402 | 5/1975 | Lankfeldt | 98/40 N |
| 3,921,507 | 11/1975 | Condt et al. | 98/40 C |
| 3,927,827 | 12/1975 | Strindehag | 98/40 N |
| 4,006,673 | 2/1977 | Meyer et al. | 98/40 A |
| 4,055,112 | 10/1977 | Lankfeldt | 98/40 N |
| 4,072,187 | 2/1978 | Lodge | 312/236 |
| 4,094,232 | 6/1978 | Howorth | 98/40 D |
| 4,135,440 | 1/1979 | Schmidt et al. | 98/31 |

FOREIGN PATENT DOCUMENTS

| | | | |
|---|---|---|---|
| 590879 | 12/1933 | Fed. Rep. of Germany | 98/40 N |
| 3702334 | 12/1977 | Fed. Rep. of Germany | 98/40 C |

*Primary Examiner*—Henry C. Yuen
*Attorney, Agent, or Firm*—Michael J. Striker

[57] ABSTRACT

A ventilating and air conditioning arrangement, especially for large office rooms, comprises at least one first air outlet through which a low speed air stream emanates for providing a basic climate in the room and at least one second air outlet for a second air stream, the volume and preferably also the direction of which is regulatable, to provide a zone having an individual climate differing from the basic climate, and in which the at least two air outlets are connected to each other to form a unit, which may be mounted on a desk or at any other convenient location in the room.

31 Claims, 13 Drawing Figures

VENTILATING AND AIR CONDITIONING ARRANGEMENT

BACKGROUND OF THE INVENTION

The present invention relates to an arrangement for ventilating and air conditioning of rooms, especially large office rooms, whereby the total volume of air to be supplied to the room is transmitted to a first air outlet through which a low speed air stream emanates for providing a basic climate in the room and a second individually adjustable air outlet to provide a zone having an individual climate differing from the basic climate.

Air conditioning arrangements are known in the art in which a part of the total air volume used for air conditioning is transmitted in form of a low speed air stream through at least one first air outlet into the room in order to create in the latter a basic climate and a second part of the total air volume is transmitted through individually adjustable air outlets to provide one of a plurality of zones having an individual climate differing from the basic climate. In this known construction the first and second air outlets may be connected to a common air supply conduit, however, the outlets for the basic climate and the outlets for the individual climate are structurally and spacedly separated from each other. Thus the outlets for the basic climate are for instance provided in the floor of the room, whereas the outlets for the individual climate are provided above the floor, for instance one or a plurality of desks located in the room.

SUMMARY OF THE INVENTION

It is an object of the present invention to provide a ventilating and air conditioning arrangement of the aforementioned kind, which, however, is improved and simplified as compared with the known arrangement.

With this and other objects in view, which will become apparent as the description proceeds, the ventilating and air conditioning arrangement for rooms, especially large office rooms, in which the total air volume fed into the room is divided into two air streams, one of low speed for providing a basic climate in the room and another air stream for providing in the room a zone having an individual climate differing from the basic climate, mainly comprises first air outlet means for the low speed air stream, second air outlet means for the other air stream, and means connecting the first and the second outlet means to a constructive unit.

The present invention is based on the recognition that the air outlet means for the basic climate and the air outlet means for the individual climate may be arranged in close proximity to each other, especially when a plurality of such air outlet means are provided in a room. The construction according to the present invention has the advantage that the expenditure for the arrangement is considerably smaller than for such arrangements known in the art, since with the arrangement according to the present invention a smaller number of air supply conduits is necessary. Furthermore, the arrangement of the air outlet for the basic climate and that for the individual climate closely adjacent to each other permits also an exact adjustment, respectively balancing, of the basic climate to the individual climate. This is not possible if, as in the prior art, the air outlets for the basic climate are spaced through relatively large distances, not originally determined, from the air outlets for the individual climate.

The arrangement according to the present invention permits not only to arrange a plurality of such units in a large room, but it permits also to provide a single of such units in a small room to provide in the latter a basic climate and an individual climate.

According to a further development of the present invention it is suggested to construct the first and the second air outlet means in form of sub-units which are constructed and connected to each other that they can function independent from each other. This will result in a versatile use of the arrangement and a rational manufacture of the same.

The thus-formed unit may be mounted, for instance, on a plate of a table.

In a further embodiment according to the present invention, the unit formed by the air outlet means for the basic climate and the air outlet for the individual climate may be mounted in, respectively on, a piece of furniture, especially a cabinet. This piece of furniture may find various applications and serve for instance as a room divider. The cabinet may also be coordinated with a desk and it is also possible that the cabinet with the two air outlet means may be fixedly connected to the desk and form with the latter an integral unit.

According to a further embodiment of the present invention, the unit comprising the air outlet means for the basic climate and the air outlet means for the individual climate is connected to a connecting channel communicating with a common air supply conduit. In this construction it is advantageous if the air outlet means for the basic climate and the air outlet means for the individual climate are releasably connected to the connecting channel. In this construction it is preferred that the air outlet means for the individual climate is arranged at an elevation above the air outlet means for the basic climate.

In such a construction the air outlet means for the individual climate may be arranged on an upright hollow cylinder mounted turnable about its longitudinal axis and carrying at its upper end a spherical housing having an air outlet opening in which a plurality of blades are adjustably arranged.

According to a further feature of the present invention a throttle is arranged between the connecting channel and the air outlet means for the individual climate. This throttle is preferably constituted by a disk turnably arranged about a horizontal axis and provided with a plurality of closely adjacent openings therethrough.

The common air supply conduit preferably is constituted by a flexible hose. This will facilitate moving the unit of the two air outlet means to different locations in the room.

According to a further feature of the present invention the air outlet means for the basic climate may comprise an elongated grate.

This construction has the advantage that the air outlet means for the basic climate may be arranged along one straight line with upwardly directed air jets, or air jets the angle to the vertical may be adjustable, which will assure a uniform distribution of the low speed air stream providing the basic climate, whereas the air stream for the individual climate may be directed toward or away from a person at a predetermined location in the room. The air stream emanating from the air outlet means for the individual climate may also be directed onto the air stream providing the basic climate to assure thereby a quick distribution of the air stream emanating from the latter over the whole room.

In a further embodiment according to the present invention the air outlet means for the individual climate is likewise formed by an elongated channel, whereby the air outlet means for the basic climate and/or for the individual climate is provided with means for adjusting the air stream passing therethrough. This adjusting means is preferably formed by a rotary slide valve turnable about an axis extending in the longitudinal direction of the elongated channel. The elongated channel forming the air outlet means for the basic and/or individual climate has an upper open side over which a grate extends. This grate is constituted by a plurality of uniformly spaced ribs extending transversely to the longitudinal direction of the elongated channel and the rotary slide valve is provided with an actuating lever connected thereto and extending through two adjacent ribs of the grate, to the outside of the latter.

The upper side of the ribs may be convexly curved and have a semi-circular configuration to facilitate divergence of the air streams passing therebetween so that in connection with the rotary slide valve the direction of these air streams may be adjusted. In this construction it is advantageous that the bottom side of the ribs are concavely curved to have a semi-circular configuration and to form together a semi-circular space in which the rotary slide valve is arranged. The opposite end faces of the ribs are connected by opposite elongated walls integral with the end faces of the ribs and extending longitudinally through the elongated channel and these walls preferably converge in downward direction toward a longitudinal plane of symmetry of the elongated channel. These elongated walls of the grate are respectively provided with outwardly projecting tongues engaging in corresponding grooves extending along upper edges of side walls forming the elongated channel. The aforementioned grooves in the side walls may be formed between elongated flanges projecting inwardly from the upper edges of the side walls and elongated inwardly projecting portions of the side walls of annular inwardly open cross-section arranged parallel and downwardly spaced from the mentioned flanges.

Such grooves preferably extend also along portions of the side walls adjacent the bottom wall of the elongated channel and they have the additional function that the opposite ends of each elongated channel may be closed by covers connected by screws threaded in corresponding portion of the aforementioned projections.

The elongated channel may be constituted by a channel shaped housing having an upper open side and a bottom wall and in this construction it is possible to arrange a second thus channel shaped housing beneath the first-mentioned channel shaped housing, which, at its upper side, is provided with the air outlet grate. The bottom wall of the upper housing is formed with a plurality of openings therethrough communicating with the interior of the lower channel shaped housing, and an air supply conduit communicates with the interior of the lower channel-shaped housing. A plurality of upper channel-shaped housings, each closed at opposite ends by covers may be arranged above a single lower housing extending over the length of all upper housings which are preferably releasably connected to the lower housing.

The grate shaped air outlets may be produced at a length from 8 to 12 centimeters so that they may be mounted on furniture pieces, especially desks of different lengths.

In a construction in which both air outlet means are formed by elongated channel shaped housings, the arrangement may be made in such a manner that such channel shaped housings are arranged in a line one beside the other with the channel shaped housing forming the air outlet means for the basic climate alternating with channel shaped housings forming the air outlet means for the individual climate. In this construction each of the air outlet means is provided with air flow regulating means which are operable independent of each other.

The ribs forming the grates have preferably the same width as the openings between adjacent ribs and this width is preferably about one-tenth of the length of the ribs, respectively of the openings.

In a further embodiment according to the present invention the air outlet means for the individual climate may be arranged above an opening in a table and movable between a first position above the table plate and a second position moved through the opening below the table plate.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
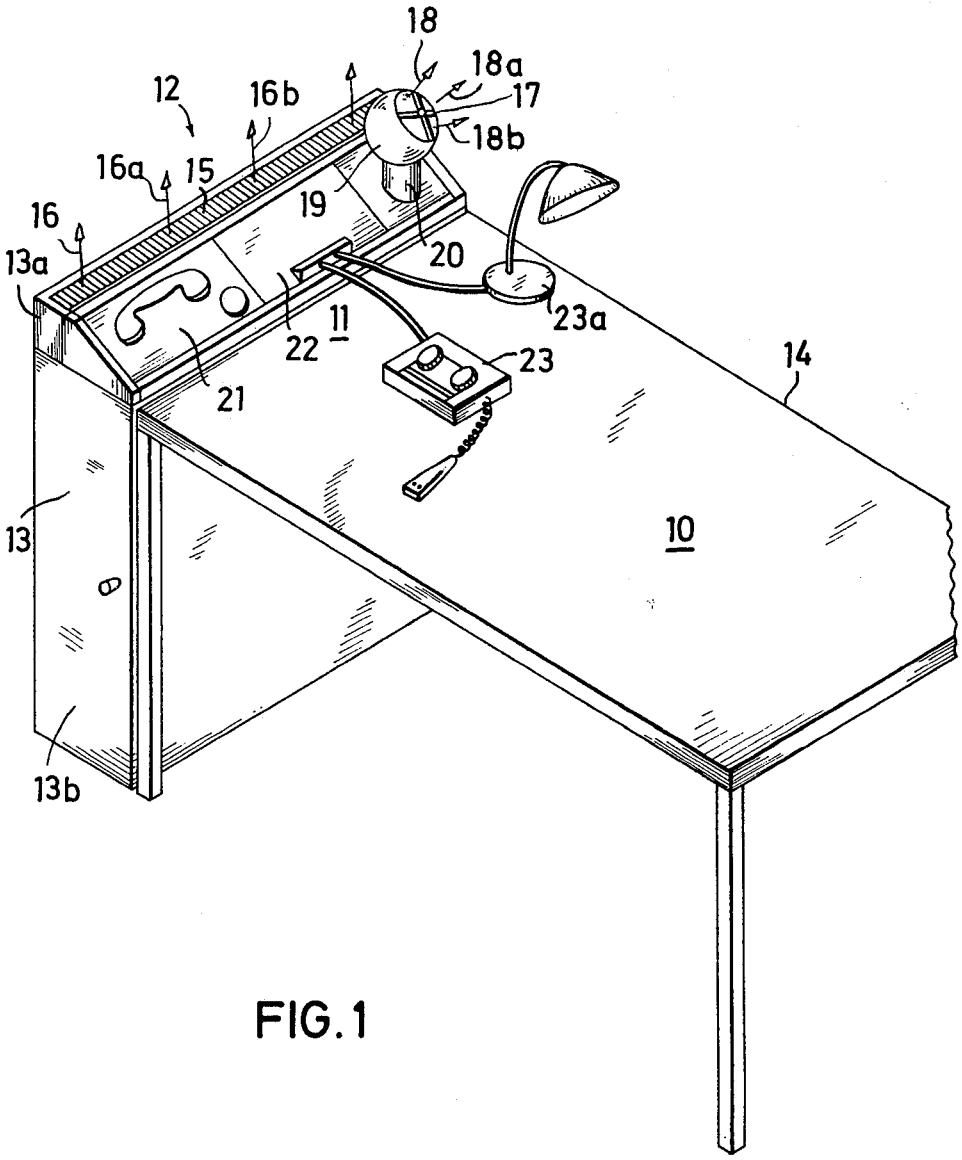
FIG. 1 is a perspective view illustrating the ventilating and air conditioning arrangement according to the present invention mounted on a desk.

FIG. 1 shows a desk 10 and a cabinet 13 arranged closely adjacent a side edge of the desk and an air conditioning arrangement 12 according to the present invention mounted on and partly in the cabinet 13. The cabinet 13 may be a separate piece of furniture mounted adjacent the desk or at a distance therefrom and can also serve as a room divider. It is especially advantageous if the cabinet 13 is fixedly connected to the desk 10 or forms an integral part of the latter. The cabinet 13 may also be arranged at the longitudinal side 14 of the desk. Of course, it is also possible to mount the upper portion 13*a* of the cabinet on the upper working face of the desk or a similar piece of furniture and to form then the lower portion 13*b* of the cabinet an integral part of the desk or similar piece of furniture.

As schematically shown in FIG. 1 the air conditioning arrangement comprises an elongated linear air outlet 15 in the form of an elongated grate for a first air stream of low speed providing a basic climate in the room in which the air conditioning arrangement according to the present invention is mounted. The air streams 16, 16*a*, 16*b*, etc. emanate as indicated by the arrows in substantially vertical direction, however, the direction of these air steams may also be changed, as will be explained later on in further detail.

The arrangement includes further an air outlet 17 for the individual climate. Air streams 18, 18*a*, 18*b*, etc. emanate from the air outlet 17 and these air streams may be adjusted to emanate parallel or divergent from each other and other direction may be further adjusted, as will be explained later on by turning and tilting the housing 19, 20 of the individual air outlet.

As shown in FIG. 1 the unit with the air outlet 15 for the basic climate and the air outlet 17 for the individual climate may also include a telephone 21 and an electrical outlet 22 for the connection for instance of a dictating machine 23 and a table lamp 23*a*.

Figure 2:
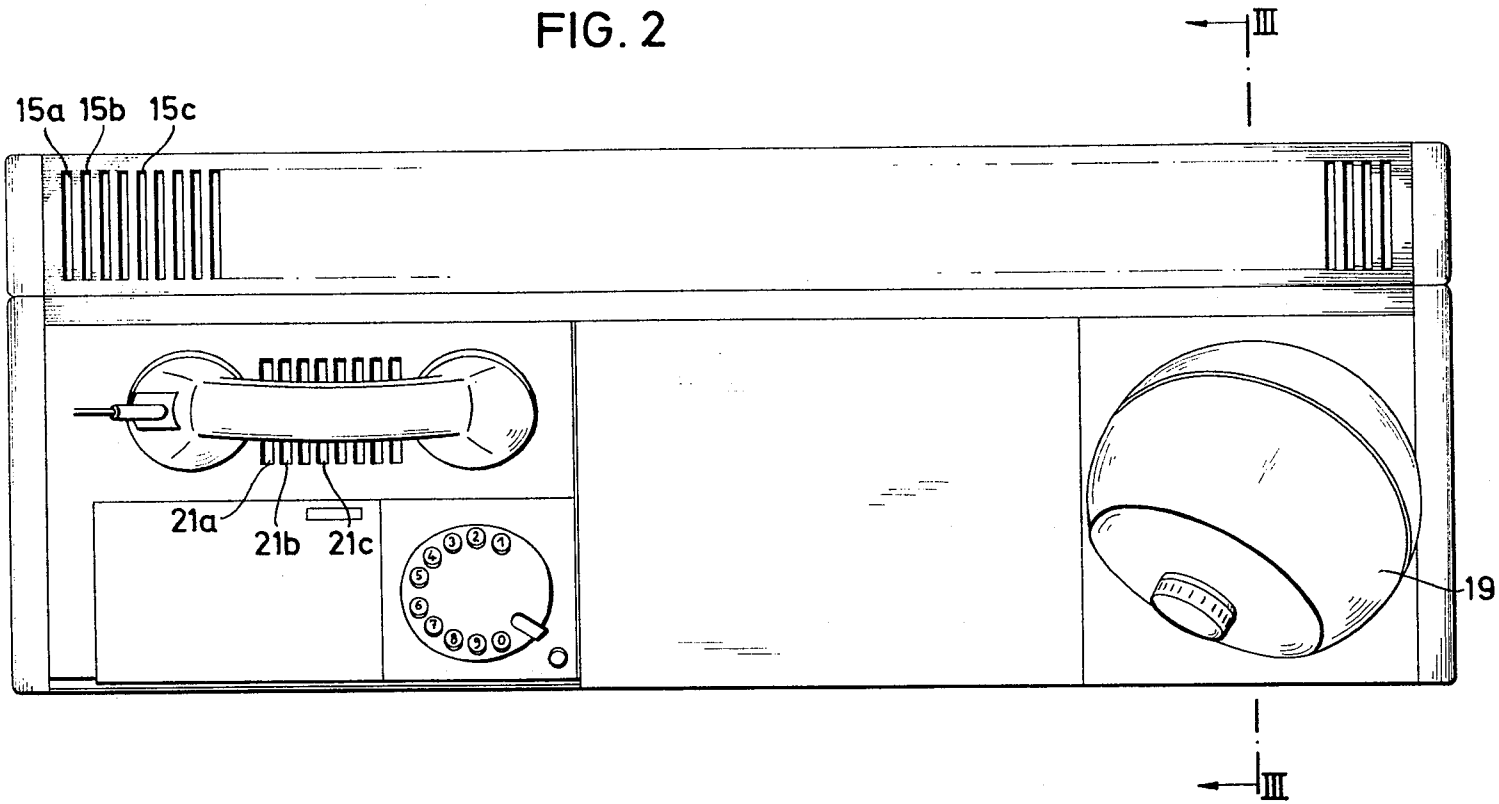
FIG. 2 is a top view of the arrangement shown in FIG. 1 drawn to an enlarged scale and shown without the desk.

As more clearly shown in FIG. 2, the linear outlet 15 is in form of a grate having closely adjacent outlet openings 15*a*, 15*b*, 15*c*, etc. The telephone apparatus 21 is also provided with openings 21*a*, 21*b*, 21*c* which correspond in shape to the air outlets 15*a*, 15*b*, etc., but which form part of a speaker or monitoring device.

Figure 3:
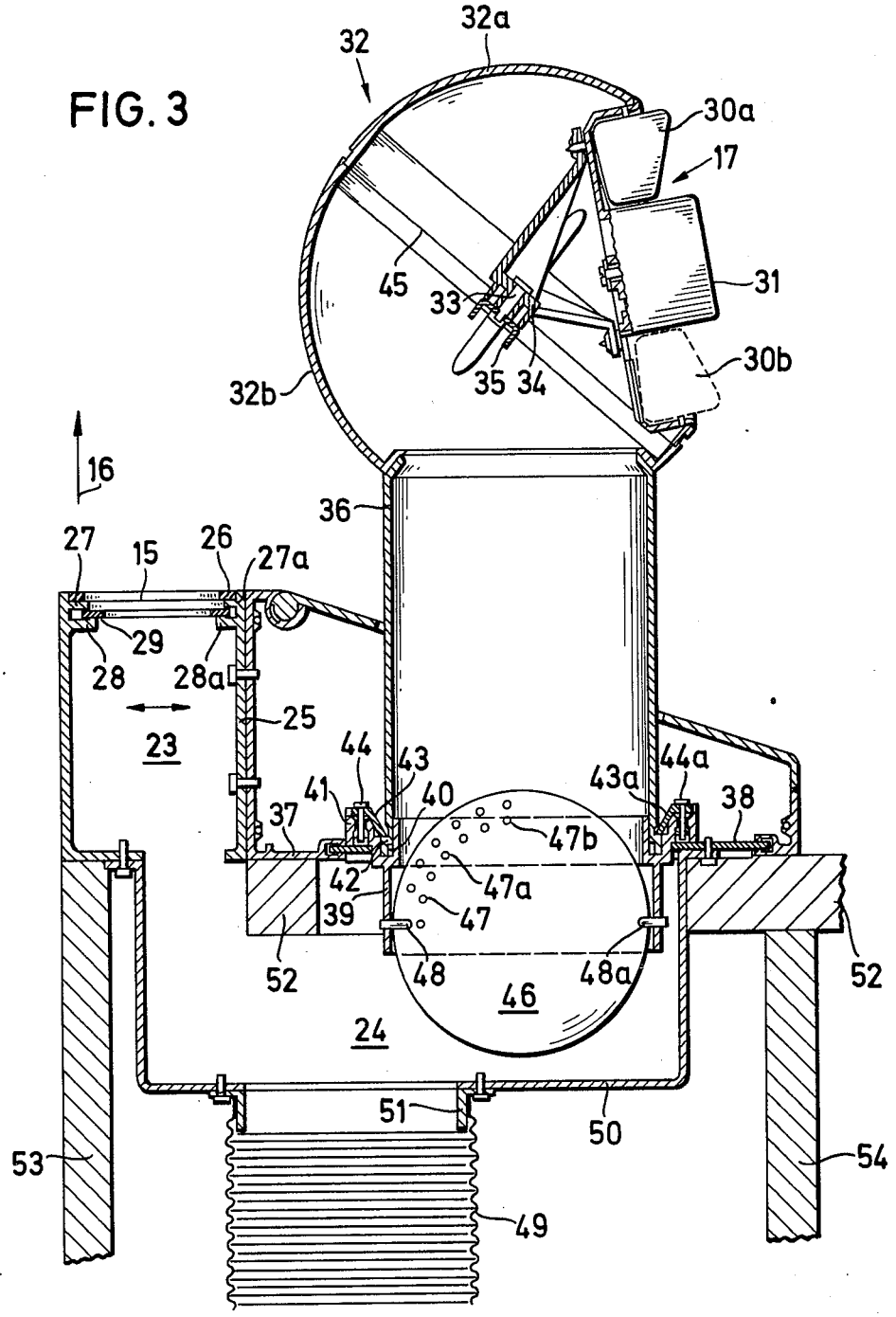
FIG. 3 is a cross-section taken along the line III—III of FIG. 2.

As shown in the cross-section of FIG. 3, the air outlet means 15 is provided on the upper side of an elongated channel of rectangular cross-section which communicates at the bottom thereof with a connecting channel 24. This connecting channel 24 is preferably only provided in the region between the housing 25 of the air outlet means 15 and the individual air outlet 17.

The housing 25 of the air outlet means 15 is preferably formed from an extruded continuous casting, for instance of light metal alloy or plastic. The housing 25 is open at its upper side and a grate 26 extends over the open upper side of the housing 25. The grate 26 rests on inwardly directed projections 27 and 27*a* on the side walls of the housing 25. Below the projections 27 and 27*a* and downwardly spaced therefrom are likewise inwardly directed further projections 28 and 28*a* which carry a slide plate 29 movable in longitudinal direction of the elongated channel 23 formed by the housing 25 and movable slightly also in a direction transverse thereto. The slide plate 29 is formed with elongated openings of a shape and spacing similar to the openings 15*a*, 15*b*, etc. of the grate so that during movement of the slide plate 29 in longitudinal direction the air outlet openings in the grate may be throttled to an increasing extent. The slide plate 29 may also be formed in such a manner that during transverse movement of the same, as indicated by the double-headed arrow, the air stream 16 may be deviated from a vertical direction. The slide plate 29 makes it therefore possible to throttle the air streams emanating from the air outlet means 15 in any desired manner and independent therefrom also to change the direction of the air streams emanating through the air outlet means 15. Preferably a permanent adjustment of the slide plate 29 is carried out during assembly so as to adjust the air streams passing through the air outlet means 15 for the basic climate. It is however, also possible to provide the slide plate 29 with an appropriate adjusting member so that the position of the same may be adjusted, after installation, according to the individual wishes of the user.

Figure 4:
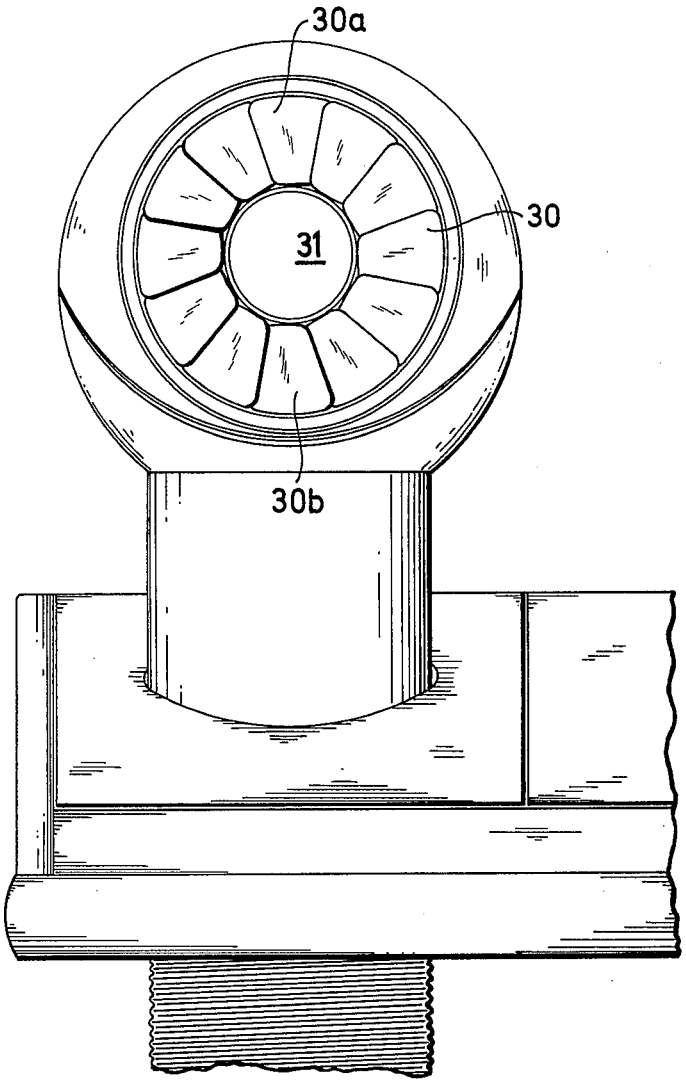
FIG. 4 is a side view of the arrangement shown in FIG. 3.

The individual air outlet 17 comprises an upright hollow cylinder 36 on which a substantially spherical housing 32 is mounted. The spherical housing 32 comprises an upper semi-spherical shell 32*a* provided with a lateral air outlet opening and a lower semi-spherical shell 32*b*, the lower open end of which is mounted on the upper end of the cylinder 36. The two shells 32*a* and 32*b* are connected by means of a screw 33 and transverse members 34 and 35 with each other. Whereas the lower shell 32*b* is fixedly connected to the upper end of the hollow cylinder 36, for instance by being cemented thereto, the upper shell 32*a* is turnable through 360° with respect to the lower shell 32*b* about the axis of the screw connection 33. A plurality of blades 30, 30*a*, etc., are mounted in the air outlet opening of the upper shell 32*a*, adjustable by means of an adjusting head 31 of known construction, not forming part of the present invention, by means of which the aforementioned blades may be turned about axes between two end positions, in one of which the outlet opening is fully open and in the other of which the outlet opening is fully closed. The hollow cylinder 36 is turnably mounted in a housing 37 connected to the housing 25. The housing 37 is provided at its lower end with a plate 38 carrying a cylinder 39 projecting with portions thereof to opposite sides of the plate 38 and provided in the region of its upper end with an annular groove 40 and a radially outwardly projecting flange shaped portion 41. The lower end of the hollow cylinder 36 is located in the annular groove 40. The hollow cylinder 36 is also provided in the region of its lower end with an outwardly projecting annular flange 42 against which fastening elements 43 and 43*a* abut, which are connected to the flange shaped portion 41 by screws 44 and 44*a*. The fastening elements 43 and 43*a* may be replaced by an annular member. By this or a smaller construction, the hollow cylinder 36 is mounted turnable through 360° about its longitudinal axis. By turning the cylinder 36 about its longitudinal axis and by turning the upper shell 32*a* with respect to the lower shell 32*b* through 360° in the plane 45 it is therefore possible to adjust the main direction of the air streams 18 emanating from the air outlet means 17 in any desired manner, whereby in addition by turning the blades 30*a*, 30*b*, etc. the direction of the air streams may be further adjusted. Preferably there are 8–12 blades provided, and as shown in FIG. 4, the blades may be brought to a position in which the air outlet 17 is completely closed.

In order to obtain also by fully opened blades a change of the speed of the air stream passing through the air outlet means 17, a throttle 46 is arranged in the cylinder 39 through which the connecting channel 24 communicates with the upright hollow cylinder 36 and this throttle preferably comprises a circular disk, for instance of plastic material, provided with the large plurality of openings 47, 47*a*, 47*b*, etc. therethrough. The disk 46 is turnable about coaxial pivot pins 48 and 48*a* which in turn are mounted in the annular housing part 39. The disk may be arrested in any position for instance by the friction at the pivot pins 48 and 48*a*.

The necessary total volume of air is fed into the connecting channel 24 by means of a conduit 49, preferably in the form of a flexible hose, one end of which is connected to an annular flange 51 arranged about an opening in the bottom wall of the housing 50 forming the connecting channel 24. The lower end of the hose 49, not shown in the drawing is preferably releasably connected to a duct in the bottom of the room in which the air conditioning arrangement is provided.

The reference numeral 52 in FIG. 3 indicates the plate of a desk and the reference numerals 53 and 54 indicate the side walls of the cabinet 13 shown in FIG. 1.

Figure 5:
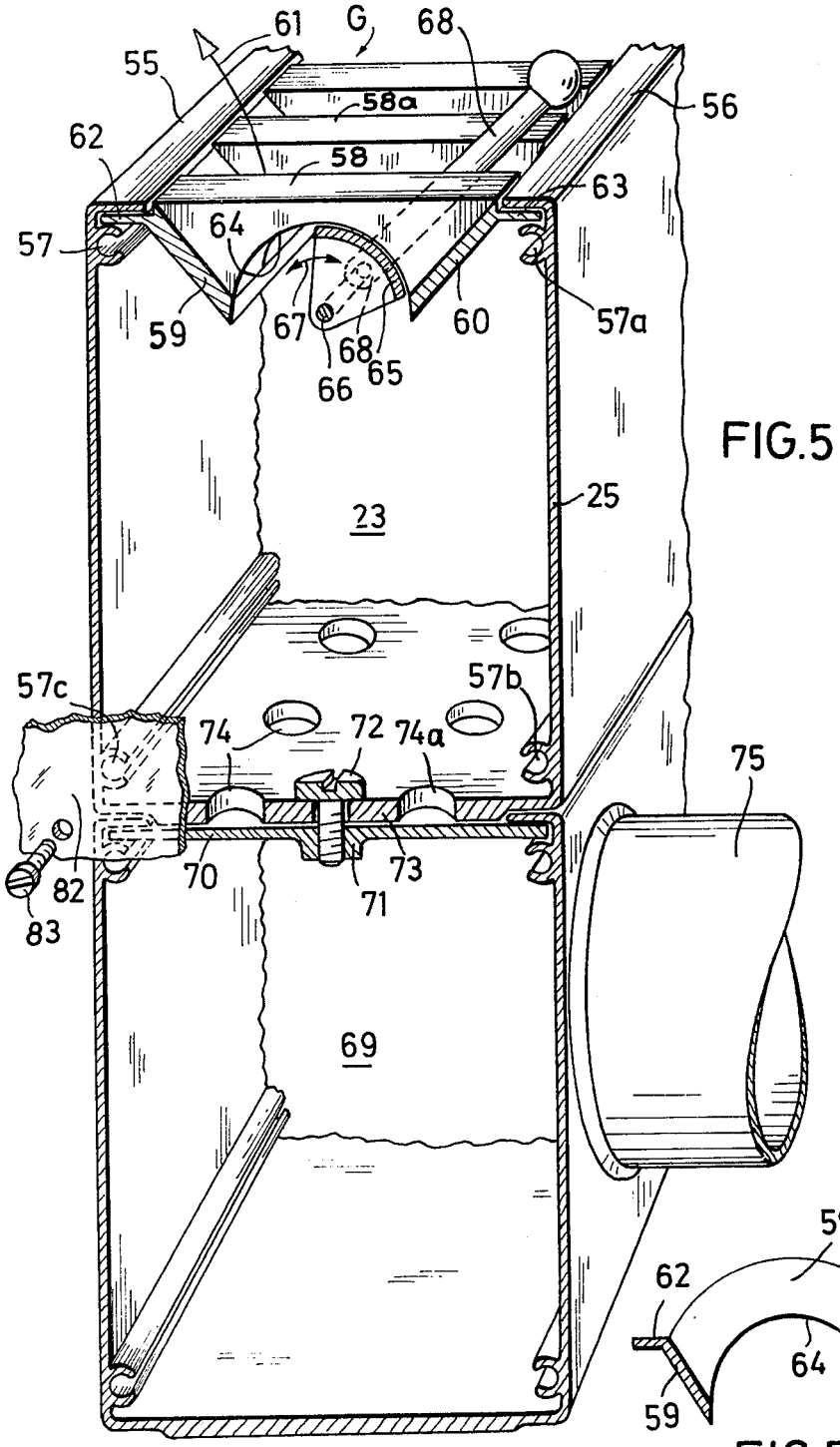
FIG. 5 is a perspective cross-sectional view of a further embodiment according to the present invention.

FIG. 5 illustrates part of another embodiment according to the present invntion, in which an elongated air outlet channel 23 formed by a continuous casting is provided for the basic climate and/or the individual climate as will be explained later on in connection with FIGS. 6 and 7. The air outlet channel 23 is formed by a housing 25 formed by continuous casting and the housing 25 has an upper open side, a pair of side walls and a bottom wall opposite the upper open side of the housing. A pair of flanges 55 and 56 respectivley project inwardly from upper edges of the side walls of the housing 25. The housing 25 has further in the region of the corners thereof inwardly projecting annular projections 57, 57*a*, 57*b* and 57*c* slotted at the inner sides thereof and forming essentially circular grooves extending in the longitudinal direction of the housing 25. These grooves serve to close opposite ends of each housing 25 by covers 82 (one of which is shown in part in FIG. 5) connected by screws 83, threaded in appropriately threaded end portion of the aforementioned grooves.

An elongated grate G extends longitudinally and transversely through the upper open side of the housing 25. This grate comprises a plurality of equally spaced ribs 58, 58*a*, etc. of equal width extending transversely through the open side of the housing 25 and being connected to each other by a pair of opposite elongated walls 59 and 60 which converge downwardly toward a longitudinal plane of symmetry of the channel 23. The elongated walls 59 and 60 are respectively provided at upper ends thereof with outwardly projecting tongues 62 and 63 which engage into corresponding grooves formed between the flanges 55 and 56 and the corresponding projections 57 and 57*a*. Air fed into the channel 23 may thus pass through openings between successive ribs in the direction as indicated by the arrow 61.

The ribs 58 and 58*a* are provided at the bottom with semi-circular cutouts 64. A rotary slide value 65 is arranged in this cutout turnable as indicated by the double-headed arrow 67 about an axis 66 extending in the longitudinal direction of the channel 23. The valve 65 may be turned about its axis by means of a lever 68 extending between two adjacent ribs to the outside of the latter. Depending on the position of the curved wall of the rotary valve 65 which extends longitudinally over a plurality of ribs, the air emanating through the spaces between the ribs is either deflected towards the left, as indicated by the arrow 61, or towards the right. By appropriately shaping the lever 68 it may also be possible to move the slide valve out of the cutout 64 in downward direction so that the air will emanate substantially in vertical upward direction.

In order to obtain a uniform discharge of air over the length of the grate G, there is arranged beneath the channel 23 an air distribution channel 69, which is likewise formed from a continuous casting and corresponding in cross-section to that of the profile of the housing 25. The connection of the two profiles to each other is carried out by a plurality of straps 70 inserted spaced from each other into the two upper grooves of the lower profile. Each of the straps is centrally provided with a threaded bore 71 and the straps are connected to the bottom wall of the upper housing 25 by screws 72 extending through appropriate openings in the bottom wall and screwed into the threaded bore 71. The bottom wall of the upper housing 25 is provided with a plurality of adjacent bores 74, 74*a*, or similar openings, so that air fed into the lower housing may pass through the openings into the upper housing.

Air is fed into the air distribution channel 69 through a connecting socket 75. The construction illustrated in FIG. 5 has the advantages that two profiles of substantially identical shape and formed from continuous castings may be used to provide a very good and uniform distribution of the air. Of course it is also possible to arrange the air distribution channel 69 laterally of the channel 23, whereby the corresponding side wall of the upper housing 25 is to be provided with the necessary openings and the casting forming the air distribution channel 69 is correspondingly modified.

The air outlet grates G with the ribs 58, 58*a*, etc., are preferably formed by sections of relatively short lengths, for instance about 10 centimeters. These sections of the grate may be manufactured by injection molding at relatively small cost.

Figure 5A:
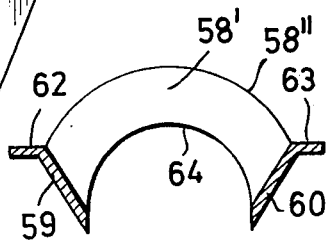
FIG. 5*a* illustrates an end view of a modification of part of the arrangement shown in FIG. 5.

While in FIG. 5, each of the ribs 58, 58*a*, etc. is provided with a planar upper surface, FIG. 5*a* shows a modification in which the upper surface 58″ of each rib 58′ is convexly curved to a semicylindrical configuration, preferably concentric with contour of the cutout 64.

Figure 6:
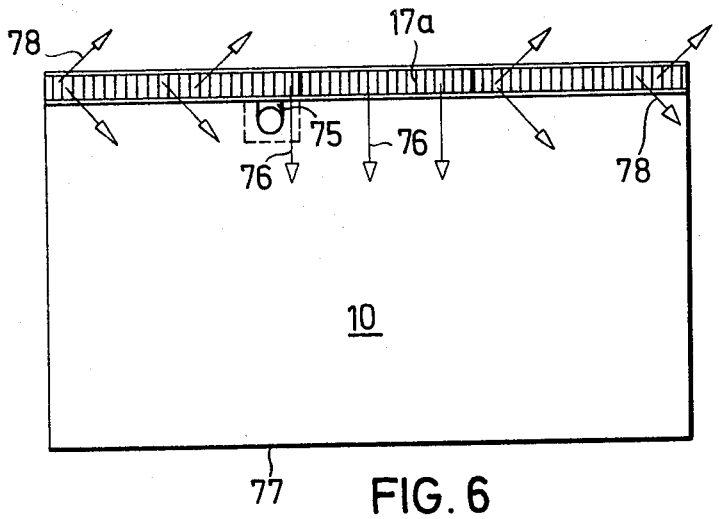
FIG. 6 is a top view of a table provided with a plurality of air outlets.

The arrangement shown in FIG. 5 may, for instance be provided along the longitudinal edge of a table 10, as shown in FIG. 6, whereby it is understood that this arrangement includes a plurality of upper housings 25 respectivey closed at opposite ends by covers 82 and a lower air distributing channel 69 extending beneath all of the upper housings and provided with an air connecting socket 75. In the construction shown in FIG. 6 there is provided an adjustable air outlet 17*a*, for instance provided with a rotary slide valve 65 as shown in FIG. 5, so that the air emanating therein may be directed selectively to the front edge 77 of the table 10, as indicated by the arrow 76, whereas the air outlets arranged at opposite sides of the air outlet 17*a* will provide air streams as indicated by the arrow 78. Of course, it is also possible to provide the laterally arranged air outlets with adjusting means to adjust the directions of the air streams passing therethrough.

Figure 7:
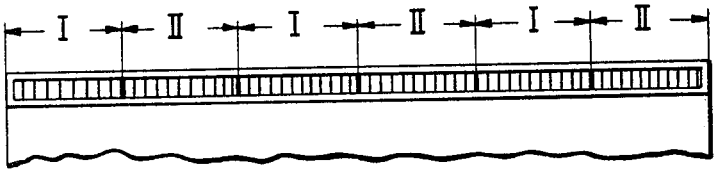
FIG. 7 is a top view similar to FIG. 6.

FIG. 7 shows an arrangement in which sections I with non-adjustable outlets alternate with sections II with adjustable air outlets. It is, however, mentioned that all sections I and II may be provided with air stream adjusting means in which, for instance for the sections II air stream adjusting means are provided with differ from those provided for the sections I. In this way a basic climate and a superimposed or independent individual climate may be provided with a very simple construction.

Figure 8:
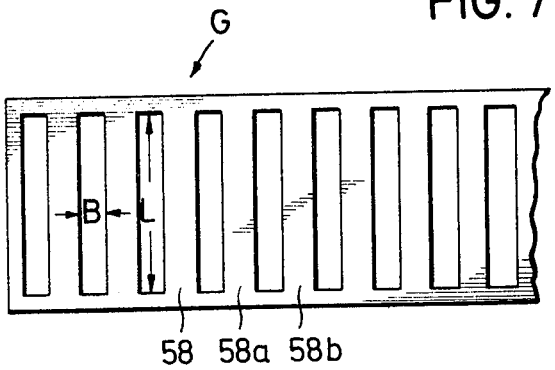
FIG. 8 is a top view of a part of a grate for one of the air outlets.

FIG. 8 shows a top view of part of a grate G. As shown in FIG. 8 the various ribs 58, 58*a*, 58*b*, etc. have a width substantially equal to the width of the openings therebetween and the width B of each opening is about one-tenth or slightly larger than one-tenth of the length L thereof. The length of each opening may, for instance, be 6 centimeters.

Figure 9:
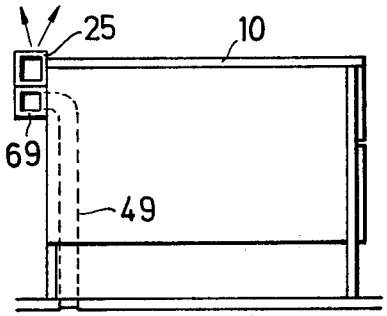
FIG. 9 is a side view of a desk provided with an air outlet channel at a longitudinal edge of the desk.

FIG. 9 shows a construction in which the air outlet in channel 25 with an air distribution channel 69 connected thereto is arranged along the side edge of a desk 10 and in which air is fed into the distribution channel 69 through a flexible conduit 49. The air outlet channel 25 may be divided in sections as explained in connection with FIGS. 6 and 7.

Figure 10:
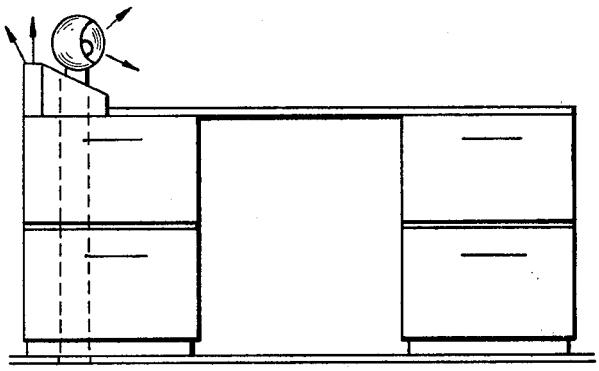
FIGS. 10 and 11 are front views showing an arrangement similar to that shown in FIG. 1 mounted on different pieces of furniture.
Figure 11:
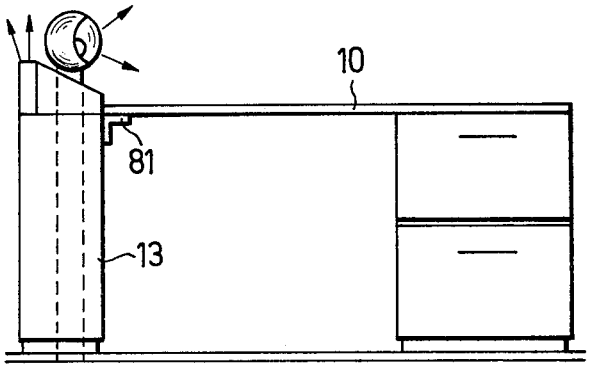

FIGS. 10 and 11 shows the air conditioning unit 12 according to FIG. 1 connected to desks of different configuration.

As mentioned before, each of these units 12 include a linear outlet 15 in form of an elongated grate for the basic climate and individually adjustable air outlet 17 for the individual climate. In the arrangement shown in FIG. 11, the cabinet 13 is connected by a bracket 81 to the plate 10 of the desk.

Figure 12:
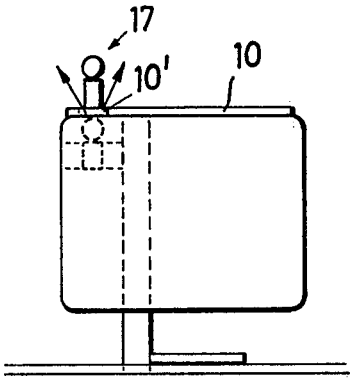
FIG. 12 schematically illustrates a table plate with a vertical adjustable air outlet, especially an air outlet for the individual climate.

Finally, FIG. 12 schematically illustrates an arrangement in which an air oulet, preferably an air outlet 17 as shown in FIGS. 1 and 3 with the spherical housing on the upper end of a hollow cylinder is movable through an opening 10' in the top plate of a desk between an upper position, shown in full lines, in which the outlet 17 is arranged above the upper surface of the plate 10 and a lowered position, shown in dotted lines, in which the air outlet 17 is moved through the opening 10' to a position below the plate 10. Movement of the air outlet 17 between the positions thereof may be carried out by any known mechanism, not forming part of the present invention and, therefore, not specifically illustrated in FIG. 12.

While the various Figures of the drawing show the air outlet means for the basic climate and the air outlet means for the individual climate mounted on various pieces of furniture, it is understood that these air outlet means may also be mounted on different elements, for instance on dividing walls of the room and at different elevations of such dividing walls.

It will be understood that each of the elements described above, or two or more together, may also find a useful application in other types of air conditioning arrangements differing from the types described above.

While the invention has been illustrated and described as embodied in an air conditioning arrangement provided with an air outlet for creating a basic climate and an at least one additional air outlet for creating an individual climate different from the basic climate, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In an air conditioning system of a room used by persons occupying one or more zones, such as work stations or the like, in which a volume of fresh air fed into the room is divided into two air streams, one of which is fed with a low speed into the room to establish in the latter an overall climate and another of which is fed with a speed differing from said low speed to at least one of said zones to provide a person occupying said one zone with a climate differing from said overall climate in said room, a combination comprising first air outlet means for the low speed air stream; second air outlet means for said other air stream; means cooperating with said second air outlet means for regulating the speed of the air stream passing therethrough and for deflecting this air stream to a variable degree; and means connecting said first and second outlet means with said means cooperating therewith to a unit, one of said air oulet means comprising an elongated channel means communicating with said air channel means and having an upper open side, and including grate means extending across said upper open side and air flow changing means comprising elongated slide means located below said grate means and movable in a plane parallel to the latter said connecting means comprise air channel means interconnecting said first and said second air outlet means, and including a common air supply conduit communicating with said channel means.

2. A combination as defined in claim 1, wherein said first and second air outlet means form sub-units, and means for regulating one independent from the other.

3. A combination as defined in claim 1, and including means for releasably connecting said first and said second air outlet means to said channel means.

4. A combination as defined in claim 1, wherein each of said air outlet means has an air outlet end and wherein the air outlet end of said second air outlet means is arranged at a higher elevation than that of said first air outlet means.

5. A combination as defined in claim 1, and including an upright hollow cylinder having a lower open end communicating with said channel means, said second outlet means being mounted on and communicating with said hollow cylinder.

6. A combination as defined in claim 5, and including means mounting said hollow cylinder turnable about its axis.

7. A combination as defined in claim 6, wherein said connecting means includes a housing having a bottom wall on which said hollow cylinder is mounted turnable about its axis, said hollow cylinder having at said lower end thereof an outwardly projecting annular flange, and including means connected to said bottom wall and engaging said annular flange for preventing axial displacement of said hollow cylinder.

8. A combination as defined in claim 7, wherein said axial displacement preventing means comprise a plurality of circumferentially displaced elements engaging said flange and means for releasably connecting said elements to said bottom wall.

9. A combination of claim 7, wherein said second air outlet means for said other air stream comprise substantially spherical housing means mounted on said open end of said hollow cylinder turnable about the longitudinal axis and having an air outlet opening, and a plurality of blades in said air outlet opening; and means for turning said blades about axes transverse to said air outlet opening between a plurality of positions including two end positions in one of which said air outlet opening is fully closed and in the other of which said air outlet means is fully opened.

10. A combination as defined in claim 9, wherein said spherical housing means comprises an upper and a lower substantially semi-spherical shell having interengaging annular edge portions located in a plane including an angle of substantially 45° with a horizontal plane, said upper shell being provided with said air outlet opening and being turnable with respect to the lower shell about an axis substantially normal to said plane of said edge portion.

11. A combination as defined in claim 1, wherein each of said air outlet means has an air outlet end, and including a throttle between said air channel means and said air outlet end of said second air outlet means.

12. A combination as defined in claim 1, wherein said common air supply conduit comprises a flexible hose.

13. A combination as defined in claim 1, wherein at least one of said air outlet means comprises elongated channel means.

14. A combination as defined in claim 1, wherein said grate means comprises a plurality of uniformly spaced ribs extending transversely to the longitudinal direction of said elongated channel means.

15. A combination as defined in claim 14, wherein said ribs have upper convexly curved semi-circular faces.

16. A combination as defined in claim 14, wherein said ribs have opposite small end faces, said grate means including further a pair of opposite elongated walls integral with said end faces and extending longitudinally through said elongated channel means, said walls converging downwardly toward a longitudinal plane of symmetry of said elongated channel means.

17. A combination as defined in claim 16, wherein said elongated channel means comprises a channel shaped housing having an upper open side, a pair of side walls and a bottom wall, and wherein said elongated walls of said grate means are respectively provided with outwardly projecting tongues engaging in corresponding grooves extending along upper edges of said side walls.

18. A combination as defined in claim 17, wherein said grooves and said side walls are formed between elongated flanges projecting inwardly from upper edges of said side walls and elongated inwardly projecting portions of the side walls of substantially circular cross-section provided with elongated slots at the inner sides thereof and arranged parallel and downwardly spaced from said flanges.

19. A combination as defined in claim 17, wherein such grooves extend also along portions of said side walls adjacent to the bottom wall of said channel shaped housing.

20. A combination as defined in claim 1, wherein at least said air outlet means comprises an elongated channel shaped housing open at one of the upper side thereof and including an elongated grate inserted in said housing over said open side thereof.

21. A combination as defined in claim 20, wherein said elongated grate comprises a plurality of uniformly spaced ribs, and wherein each of said ribs has a width which is greater than one-tenth of the length thereof.

22. A combination as defined in claim 20, and including a second elongated channel shaped housing open at one side thereof, said first-mentioned channel shaped housing having opposite said open side thereof a wall formed with a plurality of spaced openings therethrough and being connected to said second channel shaped housing with said wall extending over the open side of said second channel shaped housing, and including air inlet means communicating with said second channel shaped housing.

23. A combination as defined in claim 22, and including means connecting said first to said second channel shaped housing, said connecting means including a plurality of straps extending spaced from each other through said open side of said channel shaped housing and respectively connected at opposite ends of the latter, and screw means for connecting said straps to said wall of said first channel shaped housing.

24. A combination as defined in claim 22, wherein each of said air outlet means comprises a first elongated channel shaped housing open at one side and having an elongated grate extending over said open side, with a plurality of said first channel shaped housings arranged end-to-end with each other, with said second elongated channel shaped housing extending through the length of said plurality of first channel shaped housings and communicating with each of the latter.

25. A combination as defined in claim 24, wherein first elongated channel shaped housings constituting first air outlet means alternate with second elongated channel shaped housings constituting second air outlet means.

26. A combination as defined in claim 25, wherein each of said air outlet means comprise means for regulating the flow of air passing therethrough, and wherein each of said air flow regulating means is operable independent of any other.

27. A combination as defined in claim 24, and including means closing each of said first elongated channel shaped housings at opposite ends thereof.

28. A combination as defined in claim 1, and including a table on which said unit is mounted, said table comprising a table plate formed with an opening, and including means mounting said second air outlet means movable between a first position above the table plate and a second position moved through said opening below said table plate.

29. In an airconditioning system of a room used by persons occupying one or more zones, such as work stations or the like, in which a volume of fresh air fed into the room is divided into two air parts, one of which is fed into the room to establish in the latter an overall climate with low air velocity and another of which is fed to at least one of said zones to provide a person occupying said one zone with a climate differing from said overall climate in said room, a combination comprising first air outlet means for the low speed air part in the room and second air outlet means for said other air part; means cooperating with said second air outlet means for deflecting said other air part to a variable degree, said first and said second air outlet means being allocated to said zone; and means connecting said first and said second outlet means with said deflecting means to form a unit, one of said air outlet means comprising an elongated channel means having an upper open side, and including grate means extending across said upper one side and air flow changing means comprising a rotary slide valve turnable about an axis extending in the longitudinal direction of said elongated channel means.

30. A combination as defined in claim 29, wherein said grate means comprises a plurality of uniformly spaced ribs extending transversely to the longitudinal direction of said elongated channel means, and including a manually operable lever connected to said rotary slide valve and extending between and beyond adjacent ribs.

31. A combination as defined in claim 29, wherein said grate means comprises a plurality of uniformly spaced ribs extending transversely to the longitudinal direction of said elongated channel means and each having a concave semi-circular bottom face, said rotary slide valve having an outer peripheral surface closely adjacent to the bottom faces of said plurality of ribs.

* * * * *